United States Patent [19]

Schatz

[11] Patent Number: 4,729,421

[45] Date of Patent: Mar. 8, 1988

[54] METHOD AND DEVICE FOR THE PRODUCTION OF METAL BLOCKS, CASTINGS OR PROFILE MATERIAL WITH ENCLOSED HARD METAL GRAINS

[76] Inventor: Werner Schatz, Kurweg 81, 6719 Carlsberg, Fed. Rep. of Germany

[21] Appl. No.: 908,866

[22] Filed: Sep. 12, 1986

Related U.S. Application Data

[63] Continuation of Ser. No. 666,514, Oct. 30, 1984, abandoned.

[30] Foreign Application Priority Data

Oct. 28, 1983 [DE] Fed. Rep. of Germany ..... 3339118
Jul. 11, 1984 [DE] Fed. Rep. of Germany ..... 3425489

[51] Int. Cl.[4] ..... B22D 27/02

[52] U.S. Cl. ..... 164/457; 164/154; 164/470; 164/496; 164/497; 164/509

[58] Field of Search ..... 164/4.1, 150, 154, 155, 164/461, 469, 470, 495–497, 508, 509, 457

[56] References Cited

U.S. PATENT DOCUMENTS

| | | | |
|---|---|---|---|
| 3,565,994 | 2/1971 | Jackson | 164/497 |
| 3,672,428 | 6/1972 | Tommaney | 164/495 |
| 3,759,311 | 9/1973 | Jackson | 164/497 |
| 3,768,996 | 10/1973 | Metz | 164/496 |
| 3,776,294 | 12/1973 | Paton et al. | 164/473 |
| 3,875,990 | 4/1975 | Cooper | 164/154 |
| 4,000,361 | 12/1976 | Bondarenko | 164/154 |
| 4,027,720 | 6/1977 | Plockinger | 164/497 |
| 4,544,019 | 10/1985 | Kodama et al. | 164/497 |

FOREIGN PATENT DOCUMENTS

| | | | |
|---|---|---|---|
| 52-36504 | 3/1977 | Japan | 164/495 |
| 54-16307 | 2/1979 | Japan | 164/470 |
| 56-23239 | 3/1981 | Japan | 164/497 |
| 56-41066 | 4/1981 | Japan | 164/497 |
| 80/01574 | 8/1980 | PCT Int'l Appl. | 164/4.1 |
| 1162389 | 8/1969 | United Kingdom | 164/497 |

*Primary Examiner*—Nicholas P. Godici
*Assistant Examiner*—Richard K. Seidel
*Attorney, Agent, or Firm*—Sprung Horn Kramer & Woods

[57] ABSTRACT

Process and apparatus for the production of metal blocks, castings or profile material (14) during which molten metal (S3) in a chill (K) is moved from a heating zone (HZ) into a cooling zone according to the solidification speed of the molten metal (S3) and during which cooling time hard material grains are continuously fed through the heating zone (HZ), preferably being electrical heated molten slag (12), the temperature of which is above the melting point of the hard material, into the molten metal (S3), the temperature of which is lower than the melting point of the hard material. The temperature of the molten slag, the height (h) of it and the height of the molten metal is controlled by the control device (ST) controlling the electrical current and dosing of the materials currents. Control methods and devices as well as material selections for matrix and doping materials are described.

14 Claims, 7 Drawing Figures

Figure 1:
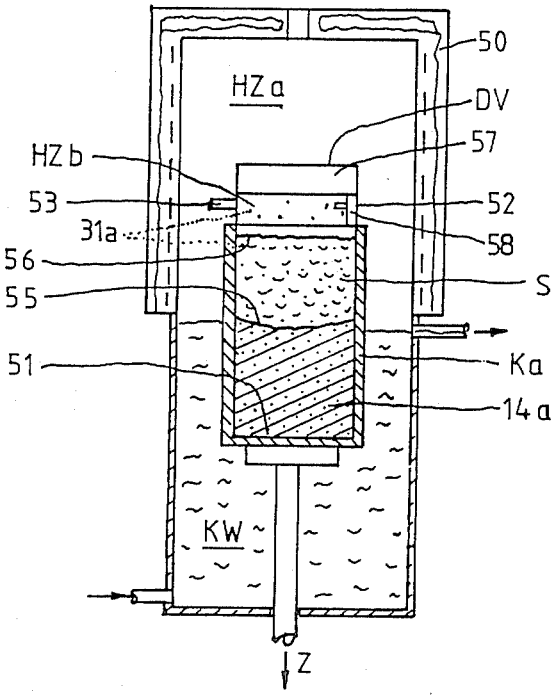

METHOD AND DEVICE FOR THE PRODUCTION OF METAL BLOCKS, CASTINGS OR PROFILE MATERIAL WITH ENCLOSED HARD METAL GRAINS

This application is a continuation of application Ser. No. 666,514, filed 10/30/84, now abandoned.

The invention relates to a method for production of metal blocks, castings or profile material from molten metal, which is transferred in a chill from an upper heating zone into a lower cooling zone, preferably cooled by water, with such a speed that the solidification of the molten metal continues.

It is known how to produce metal blocks by controlled cooling of mold metal without segregations. So that a metal obtains certain features, different admixtures of an alloy are added to the molten metal, which crystallize in differentt ways according to the concentration of the admixtures and the cooling process, whereby certain features such as hardness, toughness, weldability, wear out resistivity and workability are given. In this way a compromise always is made between the features according to each required application.

Thus, it is known as far as steel is concerned, that high toughness can be reached only when combined with low wear out resistivity e.g. in manganese steel; and high wear out resistivity is attainable only in connection with low toughness, e.g. in special metal containing carbide; and average hardness and average wear out resistivity is reached by steel alloy metal mold.

To circumvent this dilemma, it is known to use for objects which are exposed to heavy wear conditions, tough material which has a protection layer welded on hard. This contains an increased carbide portion, which under certain conditions is reached by means of continuous scattering of metal carbides into the welding pool. This method is very expensive and has only limited success, because the protection layers can only be applied in limited thickness, and they tend to split off. If more layers are put on top of each other uncontrollable cracks appear, which can lead to an increased crumbling of the layer.

Furthermore, it is known how to produce castings with ingredients of hard materials, e.g. from tungsten-, titanium-, tantalum carbide or from hard metal scrap, whereby the hard material grains are poured over with such a relatively cold molten steel that they do not melt at their surface, but are only kept solid by means of the compression of the steel matrix at solidifying due to its larger thermal expansion coefficients. Therefore, under heavy stress the hard material grains, which are at the surface of a work piece, tend to break off relatively easily.

An additional known method is to pour over hard metal grains a molten matrix material, whereby its temperature is so far above the melting temperature of the hard material grains that they melt to a large extent, because the cooling off times last several minutes. There are two versions of this method known; one is characterized in that the hard material is alloyed with cobalt or other admixtures which lower its melting point, and the other is characterized by the application of a very high temperature at which a decomposition of the carbides takes place and leads to a carbonisation of the steel matrix.

In the first case, the hard material has lower hardness and in the second case the hardness of the matrix is decreased considerably. Moreover, a large part of the hard material is dissolved and recrystallizes in mixcrystals, in particularly also carbon of low strength is decomposed from the molten. This further leads to the formation of shrinkholes and cracks which results in the hard material grains easily breaking off when stress is applied.

It is the task of the invention to show a method by which metal blocks, metal castings or metal profile parts can be produced on a large scale relatively simply, the products providing both high toughness as well as high wear out resistivity and in which the hard material grains are equally strongly bound into the metal, especially steel, matrix and a relatively small amount of hard material leaves the grains into the matrix and crystallizes there, so that a weakening of the matrix by shrinkholes and decomposition products of the hard material, in particular carbon particles, does not occur.

The solution of the task is given that the hard material in the form of powder, grains or crystal grains is brought during the cooling of the molten from the upper heating zone into the molten metal, which has a temperature below the melting temperature of the hard material, and is measured and distributed over the surface of the molten.

An extremely tight binding of the hard material grains into the metal matrix is attained when they are heated for a short time in the heating zone on their surface above their melting point.

If the height of the molten metal is relatively large, e.g. in a chill moulding chest, that may be 1 meter, the transit time of the hard material grains of e.g. 30 seconds from the surface of the molten metal to the bottom of the chill chest is considered in such a way that the scattering of the hard material grains is started earlier about the transit time before starting the cooling of the chill chest and that the distribution of the scattering is done in the cooling time, inclusive transit time, so that the hard material grains are distributed over the height of the cooled off material block according to the time of the distribution of the scattering.

An improved solution of the task is given by a method by which the heating zone consists of a layer of molten slag, which is heated by electrical resistive heating above the melting temperature of the hard metal grains and the height of which is so large that the hard material grains only melt on the surfce, and in which continuously molten metal is added to the cooling off molten metal in such a current that its temperature is below the melting temperature of the hard material grains.

The hard material grains stay for only about one second in the hot molten slag and then sink into the molten metal. According to measurements on metal blocks during solidification of the metal surrounding the hard material grains, there remains a zone of a depth of a few micrometers, in which steel components invade into the hard material surface and finally solidify in an eutectic state. The shortly liquidized hard material generates a dendrite zone of 100 to 300 micrometers depth; the crystal structures are undereutectic because of the quick cooling process. Furthermore, a slight diffusion of hard material occurs in the dentrite zone and also slightly in the steel matrix.

The height of the molten metal is thus kept so advantageously low that the sink time of the hard material grains is relatively short.

Because of the continuous pouring of molten metal into the chill, an equilibrium of the concentrations of the alloy materials and the diffusing hard material grains is always present, thus a continuous enrichment and therewith a decomposition during crystallisation is avoided, and a homogeneous final product is produced.

In this way different types of steel material can be employed according to the conditions of the different applications, the steel material doped with hard material is according to the undoped steel relatively tough, weldable and forgable, and has depending on the doping extreme hardness and wear out resistivity, thus it is ony workable with difficulty.

For example, such metal consisting of a matrix made from highly chronium alloyed steel and containing tungsten carbid doping shows higher wear out resistivity than sintered hard metal of S2 type or than HSS welding steel. This material can be welded without fissures or cracks under protection gas or with electric butt welding.

In this way, such parts of a work piece as, for example, the point of a chisel, the cutting edge of a plough, the cutting edge of a scraper tooth etc., can be made from doped material onto which can be welded the holders or blades or shafts, which eventually are to be worked.

The process, in which continuously according to the speed of solidification new molten metal is fed to the chill can be advantageously carried out in a string chill, so that not only blocks or castings but also profil material of unlimited length can be produced. Especially this string moulding process is usuable to produce certain wanted doping zones distributed over the cross section, and, for example to scatter hard material grains on the outer zone which later undergoes wear stress which leads to a relatively precise distribution of the hard material grains in the final product, on account of the small molten height. The undoped zone, e.g. the inner part, can thus be machined (drilled), and the tension strength is increased because of the undisturbed matrix in the inner zone.

It is a further advantage of the method that it is applicable to non iron metals e.g. light weight metal alloys. In this way new possibilities to construct wear out resistive armours, plane or rocket parts are given.

This completely new family of materials is not only applicable to improve the life time of wear out effected machine parts and tools or to cheaper their production, but it also give completely new possibilities for assemblies, in which the necessary various features have been realised until now by assembled components, for example hard metal head in a drill or cutting steel.

Particularly advantageous is also the application of the new material in products, which are affected by wear out and which should present high friction, as is the case for rims of railway cars, since the hard material grains, which minimally stand out of the surface, lead to an increase in the roughness and thus the friction. This effect can be modelled according to the application conditions by using grains size, grain form and type of hard material as appropriate.

The advantageous combination of features of a tungsten carbide doped steel is listed below:

high wear out, blow and friction resistivity,
bendable, rollable, forgable,
resistivity against cracking or breaking
electrical weldable without preheating and without danger of cracks
hardable, heat treatable.

For the application of the method it is necessary to use such a hard material which does not dissolve at the temperature of the molten metal. Further, it is essential that its specific weight is larger than that of the molten metal, so that it sinks.

The hard material grains can be won from natural products or can be won from sintering or melting and eventually necessary grinding. In many cases it is also possible to use hard metal scrap of appropriate size.

To reach a defined distribution of hard material and thus homogeneous material features of the end product, it is necessary to separate the grains according to size. This can be done with sieves or by air or water separation. Instead of a zonewise homogeneous distribution of hard material grains in the end product, by means of a variable doping procedure, certain doping profiles can be produced, which result in, for example a graded continuous transition of zones.

With the same method of scattering grains, powder or crystals in cooling molten metal it is advantageously possible to give other features to the material, e.g. bad weldability and cuttability, e.g. for armour plates. One example is the doping of light weight metal with silicon oxide or corund may be mentioned.

Several doping materials for the production of different features, e.g. tungsten carbide for wear out resistivity and Silicon oxide for fire resistivity, can be applied combined in one moulding process when properly controlled in timing and quantity of doping. In this way even further new type of feature combinations of materials are achieved. The selection of alloys and the respective doping concentration can be defined by an expert without any difficulty, by carrying out small experimental stages.

The chill can have a cross section which is as usual adapted to the further application of the profile produced. By introducing a core, a hollow profile is produced, which is flowed through by cooling water as the outer chill.

Alloys and mixtures with hard materials:

A preferred selection is given in the following examples. The industrial applications under the scope of different wear out mechanisms are discussed. There are four main groups of wear out:

(a) Non-alloyed or low alloyed steel doped with hard material: the alloy is characterized by a content of 0.8–1.8% manganese and by about 1% silicon. Apart from the mechanical technological quality values given by the silicon, the high silicon content also influences the melting process in the chill. Without sufficient silicon content there is no adequate calmness in the melting process, if the molten material is delivered by melting of an electrode. The silicon can be scattered into the molten high temperature slag or it can be part of the electrode material. This matrix material should be doped with 80 to 250 g hard material per 1 kg steel alloy. Doping with less than 80 g gives an underproportional result with respect to wear out resistivity. More than 250 g hard material doping leads to cracking when bending strength is applied. In this the grains of the hard material have an effect. The size of the grains is mainly defined by the wearout conditions given. The basic rule is: grain diameter up to 0.8 mm is advantageous if rolling, beating or friction stress occurs. Against heavy grinding and cutting stress as, for example, in drilling heads, a larger size of grains, for example, 3 to 5 mm is much better.

(b) Martensitic steel:

In this category are predominantly steels which endure heavy mineral grinding wear. By doping with hard material the wear out resistivity is improved by far. Preferred martensitic alloys are listed according to increasing hardness RC (Rockwell) in table 1.

(c) Austenitic steel:

Under this group there are the rustless and acid resistive stainless chromium-nickel-steel alloys. For example, containing 18% Cr, 8% Ni, or 19% cr, 9% Ni and Mo, or the welding material known with 18% Cr, 8% Ni, 6% Mn (work material no. 1.4370). These alloys are used if corrosive environment is expected. In no way do they offer protection against mechanical, in particular mineral abrasive wear. By doping hard material according to the invention completely new applications are possible, unlike before.

Further manganese hard steel is to be mentioned here. These are characterized by 1.2% carbon content and 12 to 17% manganese. They fulfil specifically beat, pressure and pressure conditions. Only limited resistance against abrasive wear is given. Also by doping of such material, new applications are possible because of improvement of abrasive resistivity. A new special alloy which is resistive to highest beat and abrasion wear is given by:

C=1.0%, Si=1.8%, Mn=17%, Cr=17%, W=3.5% (average amounts). Doped with hard material according to the invention the abrasive resistance is improved by far, and thus a completely new work material is available for many applications which have extreme demands.

(d) Nickel based alloys.

Materials, containing high levels of nickel, are improper to use under heat and abrasion wear conditions. By doping with hard metal grains according to the invention also nickel, Inconel, Hastelloy B, Hastelloy C are usable under high abrasive conditions. The extremely good corrosion resistivity—even at higher temperatures—offers completely new applications with the hard material binding, since, during the binding procedure, no corrosion decomposition particles from the molten metal are built into the matrix.

The continuous working procedure of the moulding device has the advantage that the solidification of the matrix material is oriented in vertical direction, and dense material of good workability is generated. This advantage is by using a heating zone with electrical heated slag, also available to high proportions of chromium containing alloys.

The electrical heating of the slag generates an intense revolving movement in the slag as well as in the molten metal. By the negative resistance characteristic of the slag material as well as by the magnetic field of the current a continuous movement of the current path in the slag, and of the region of highest temperature takes place. These effects are increased by a continuous cross or circle movement of the electrode. Thus the continuous revolving movement of the molten metal leads to a fine grain crystallisation. This effect is further increased because the molten slag is at higher temperature than the molten metal, so that the material of the molten material is constantly surrounded between the hotter boundary area of the slag and the cooler crystallisation zone; eventually decomposed crystals are dissolved in the higher temperature area again. Further the elimination of gas is improved in the hotter area.

It is an advantage that a thin layer of slag covers the chill wall, which is in its red glowing consistence a good gliding measure during the tearing out of the solidified material, so that no other carbons containing gliding grease or oil are to be injected, no carbonisation of the metal takes place, no gaseous component is added, and no injection device is needed.

It is a further advantageous variation of the process to introduce such alloy materials which have relatively low melting points at a temperature slightly above their melting points and to introduce at high temperatures melting materials with the melting electrode embedded. This material molten in the slag crystallizes during the shining through the molten metal in fine grain crystals which are built in the matrix in the solidification zone forming mixed crystals strongly bound there.

Figure 5:
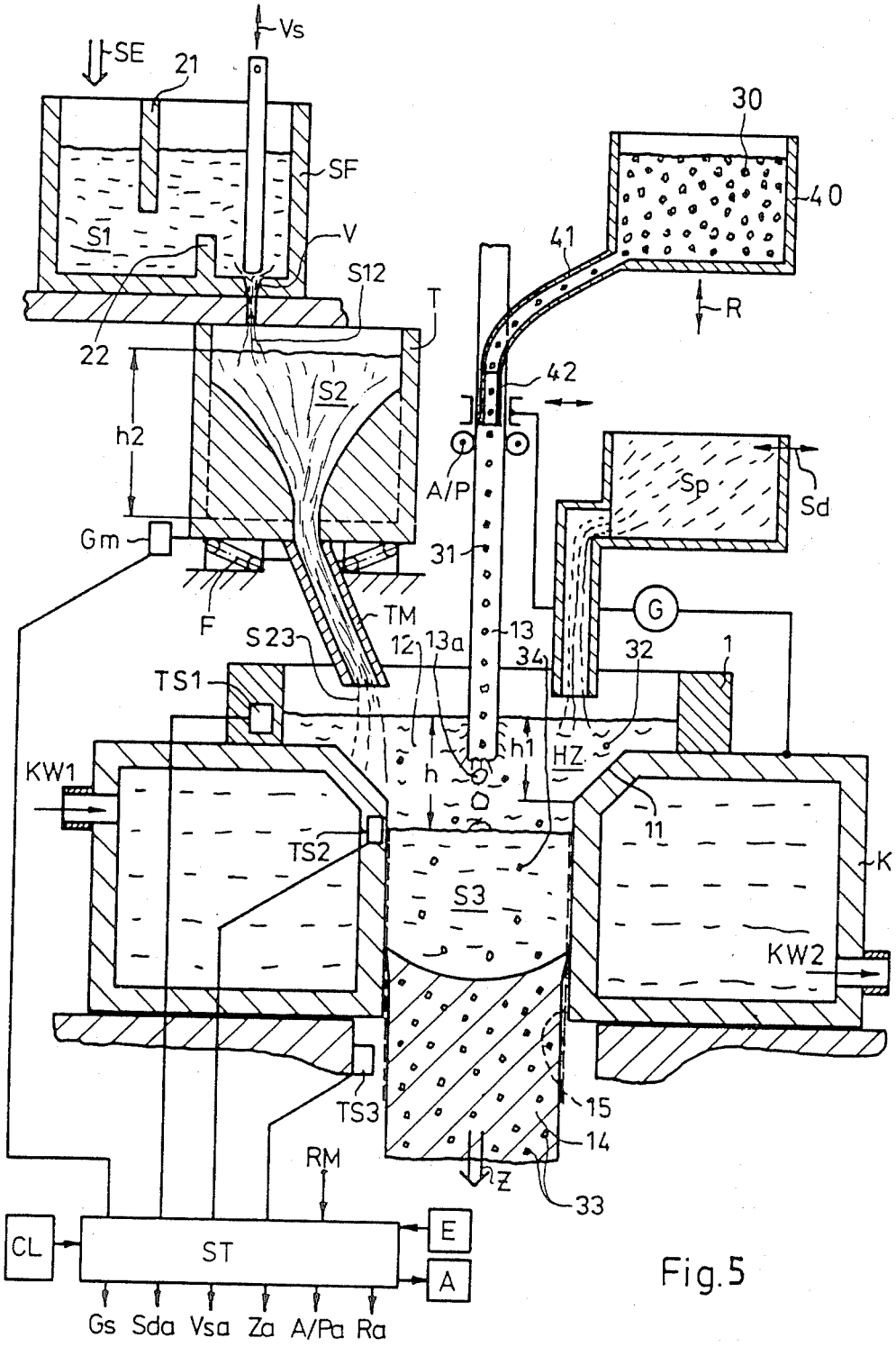

Advice for delivering an exactly controlled molten metal current thereby avoiding the introduction of gas and dirt is shown in the description of FIG. 5.

For the control of the device to perform the process, temperature sensors are placed at the chill and monitor signals from the drives are fed to the control of the process according to given criteria.

Figure 2:
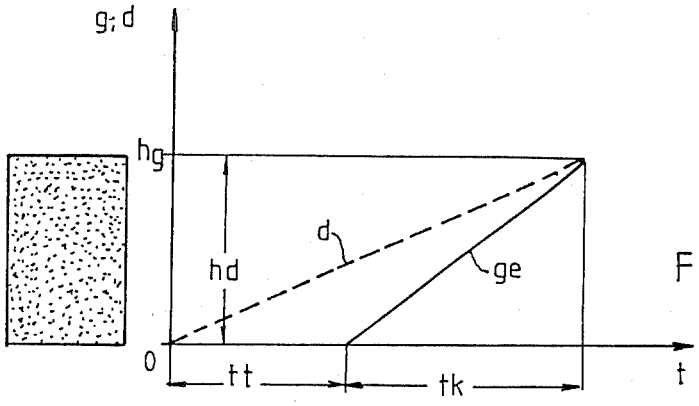
Figure 3:
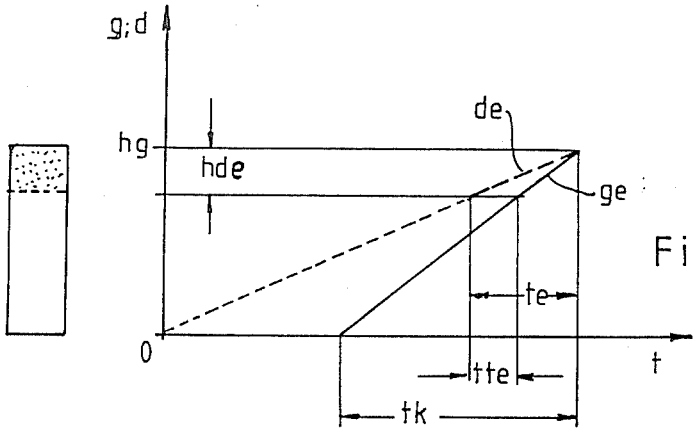
Figure 4:
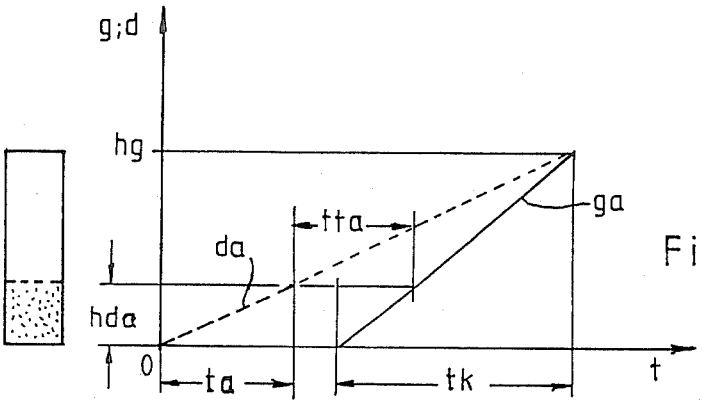
Figure 6:
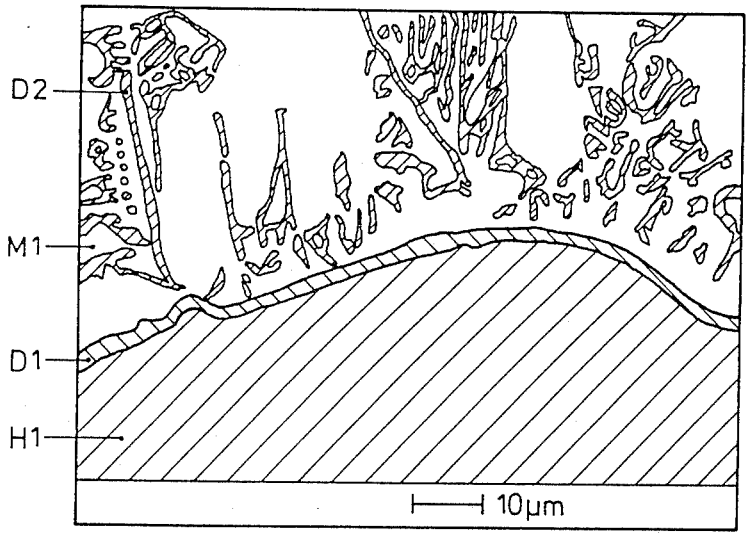
Figure 7:
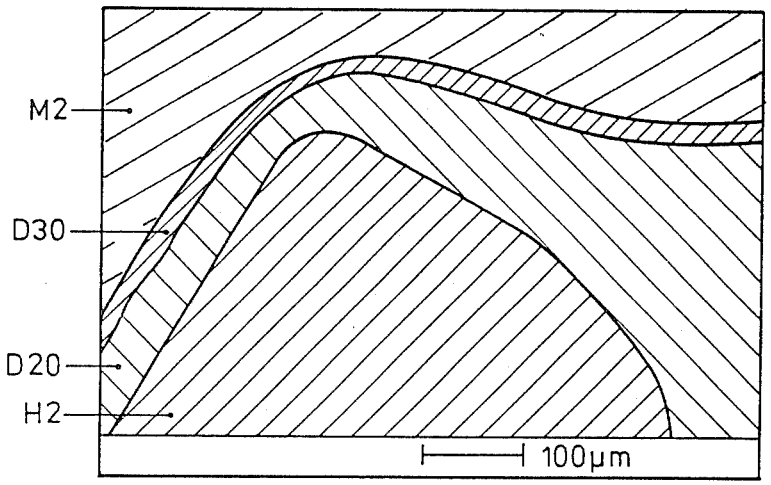

Short description of the drawings:

FIG. 1 diving moulding device, vertical cut;

FIG. 2–4 doped blocks out, and also timing diagrams of cooling doping;

FIG. 5 continous moulding device, vertical cut, partly schematic;

FIG. 6 cross-section of hard material grain boundary, enlarged by electron microscope;

FIG. 7 as FIG. 6 but smaller scale enlargement.

For the production of blocks and hollow blocks according to the process a modified chest or diving moulding device is applicable. In FIG. 1 such a device is shown. At the beginning of the process the chill Ka is placed in heating zone HZa in heating chest 50. The chill is filled with molten metal S, then the dosing device DV with the controllable scattering device 57 for hard material grains 31*a* is placed above the upper surface 56 of the molten metal S. For cooling of the molten metal it is dived with the chill Ka from the heating zone HZa into the cooling zone, which is the cooling water KW, with a given diving speed, so that the boundary 55 between the solidified material 14*a* and the molten material S is nearly flat and thus the diving speed into the cooling water is equal to the speed of solidification of the molten metal. This way decomposition is avoided. There is an equivalent solution to the diving downward shown, to raise the level of the cooling water KW surrounding the chill accordingly and to lift the heating chest 50 in parallel.

To reach a homogeneous distribution of hard material grains 33*a* in the solidified material 14*a*, that is the block produced, it is provided according to FIG. 2 to distribute the scattering of the total amount of hard material equally over a total period which adds up from the sinking or transit time tt of the grains via the total height hg of the molten material S and the adjacent cooling time tk. The diving of the chill Ka starts as soon as the hard material grains reach the bottom 51 of the chill.

FIG. 2 gives a timing diagram for that. The line ge shows the position of the boundary 55 relative to the bottom 51 of the chill, and line d shows the scattered amount of hard material grains relative to the total amount; hd gives the height of the doped zone.

For certain machine parts, which will be produced from the solidified material, it is preferred that only a zone, e.g. at the top part of a drill, is abrasion resistive. Then corresponding to the position of the zone to be doped hde, hda relative to the total height hg the scattering of the hard material takes place in time slots te, ta related to the total period tt+tk. (FIG. 3, FIG. 4).

By this method there results the counter movement of the sinking of the grains 34*a* in the molten metal S and the growing up of the solidifying material 14*a*. By the precharge time S tte, tta the scattering is started earlier than the grains arrive at the boundary 55.

In FIG. 3 a preferred version is shown compared to FIG. 4 because tolerances are narrower due to shorter sinking time. It is in the scope of the invention to superimpose the procedures according to FIG. 3 and FIG. 4 whereby both ends of the produced block are doped.

It is also possible to produce even more doped zones in the vertical direction of a block. These zones can be separated by simple means at the undoped cross sections.

Up to a certain degree an inhomogeneous scattering of the hard material grains over the horizontal cross section can be performed. For example, increased doping can be done in the outer region. Because the sinking of the grains is due to turbulences not strictly vertical, a sideaway deviation must be anticipated, which results in no exact side way limitation of the zones.

The chill may vary in its cross section depending on the application. A central core, which is cooled from inside with ascending cooling water as the outer chill may be provided for the production of hollow blocks.

To avoid that the sinking of the hard material grains is hindered by foam on the surface 56 of the molten metal S, and that no air is imported by the hard material grains 31*a* into the molten metal, which would lead to incomplete binding of the hard material grains to the matrix, there is in a preferred embodiment, between the scattering device 57 and the surface 56 protection gas, e.g. argon, nitrogen or carbon oxide, depending on the type of metal used a vacuum of a few torr is produced, which has the advantage of further elimination of gas from the molten metal S. For that purpose between chill Ka and the scattering device 57 a vacuum tight chest 52 with an inlet pipe 53 for gas or vacuum supply is arranged. Preferred there is placed in the chest 52 a heating device, e.g. a plasma heating device 58, in order to pass through hard material grains 31*a* so that a heating zone HZb is directly placed on top of the surface 56 of the molten material S.

In this heating zone HZb the hard material grains are heated shortly at their surface and as a result they are more tightly embedded into the matrix. The control of the doping and the scattering over the cross section and the phase of the scattering related to the transit and cooling time is done by means known to an expert as shaker and time control switches as is shown e.g. in FIG. 5 with a controllable shaker R and a shuttle device. The control circuit is preferred completed to a closed loop control for which purpose continuously the position of the boundary 55 of the solidifying material is measured, e.g. by acoustic ranging, and depending on this the movement of the cooling zone, e.g. the ascending of the cooling water, and the doping times are controlled.

Instead of sections of homogeneous doped material variable doping profiles are achievable, e.g. a graduate transition of zones can be made.

The method allows other ingredients than hard materials to be applied to the molten metal in order to modify other features, e.g. bad weldability or cutability, which is advantageous for shields or safety equipment. For example, doping with quartz or corund of light weight metal alloys can be done.

Different multiple filling materials to modify various features can be applied, e.g. tungsten carbide for abrasion resistivity and quartz for fire hardening, if scattered into the molten metal at the individul related times. a new inventive feature combination can be reached by this.

In FIG. 5 a continuous working chill device for the application of the method using electrical heated molten slag as the heating zone HZ is shown in a vertical cut and partly schematic. Without changing the method applied other cross sections of the chill can be used. The shown pouring and doping device can be replaced by others, only their basic functions are shown.

The vertical cut shown chill K is made out of copper, and cooling water flows between the connecting pipes KW 1, KW 2. The horizontal cross section can be round or rectangular. If the rectangle is much longer than wide—related to the drawing—, e.g. for the production of sheets, then several electrodes 13 are to be placed every few centimeters in parallel so that an adequate current flow in the molten slag 12 is reached. If the chill is closed at the bottom, this means no pulling device Z is provided, castings can be produced according to the shape of the chill. The chill then can be divided into at least two halves for removing the casting when it is cooled off.

The chill K shown is used for round material. Normally such can b produced with 30 mm diameters and above. To produce smaller diameter material a wider melting volume is provided for the molten slag. A steel ring 1 is placed on top of the copper chill K.

The parallel arrangement of several electrical powered electrodes 13 flat material, e.g. of $20\times200$ mm$^2$ cross section, can be produced. The electrodes perform a shuttle movement. The hard material 31 is scattered between the electrodes. This way a homogeneous distribution is reached. The distribution is improved by the shuttle movement and the strong magnetic moving field around the current paths. This distribution effect is especially effective when sinter carbide or hard metal scrap is used. In this case the hard metal particles 31 are attracted by the magnetic field and pull them to the electrode 13. By continous melting of the electrode and equal shuttle movement the homogeneous distribution is performed.

A raw product for rolling mill products has a cross section of $40\times40$ mm$^2$, $50\times50$ mm$^2$ or $60\times60$ mm$^2$. To get a failure free material, at least 2 to 3 electrodes 13 should be used and shuttled crosswise over the square cross section. In the same way cross wise moving the hard material grains 31 are scattered into the molten metal 12 or 53. If the crossway movement is not applied, slag holes can occur near to the wall of the chill. The scattering of the hard material into the center of the cross section leads to a central column of hard material which may lead to cracking of the crystal column during a rolling procedure later done.

Related to the type of carbide used the distribution over the cross section is to be controlled differently. Molten tungsten carbide has the tendency to sink into the deeper middle part of the boundary, and sintered tungsten carbide is driven by the magnetic field to the wall of the chill. In this case the ready product is showing grains at its surface, which is normally wanted.

Cross sections of more than 70×70 $mm^2$ lead more often to formation of a crystal column. Flat profiles are much easier to produce in this respect. FIG. 5 gives an example for the other cross sections.

After solidification the profile material leaves the chill in a red glow warm state, and its extraction temperature is about 900° to 1,000° C. Further down from the chill first the slag layer 15 is cooling off and it splits off the surface nearly complete.

If the matrix material is molten separate from the chill then the molten metal S1 is fed through inlet SE into a slag catch chest SF where it is cleaned by the slag catchers 21,22 from top and bottom, and from where it sinks through a controllable bottom valve V into the molding funnel T, which is rotation symmetrical to its vertical axis and shaped in its vertical cross section in such a way, that the sinking molten material S2 does not rotate and accordingly will not attract air into it.

The mouth TM of the funnel is close over the molten slag 12 placed near to the region of the enlargement 11 of the chill K. The current S23 inflowing to the chill K is given by the height h2 of the molten S2 in the funnel T. It may therefore be provided to control the bottom valve V by the valve control VS depending on the height h2. But in the example shown it is provided to measure continuously the weight of the filled funnel T, which is mounted on a spring F and connected to a weight sensor Gm, so that the inflowing current 12 into the funnel T is equal to the outflowing current S 23, which has a given magnitude, which on the other hand must be equal to the amount of solidified material being extracted to get an equilibrium state through the continuous process state, whereby the start up condition is given in that a prescribed height of the molten metal in the chill is to be reached, and whereby the extraction speed of the extraction device 7 is controlled by the extraction temperature signalized by the temperature sensor TS3 underneath the chill K.

The molten slag 12 is held in the funnel shaped upper part N of the chill K, which leads into the rim 1, which is not cooled by inside water but only by heat conduction to the chill. The height h of the molten slag is stabilized by stewing of slag powder SP by means of a slag dosing device Sd, e.g. a shaker device, into the molten slag 12.

The hard material grains 30 are stored in a chest 40 from which by means of the controllable shaker R at its bottom, a dosed current of grains 31 via the hose 41 and its mouth 42, which ends preferably adjacent to the electrode 31, being connected to the shuttle device A/P and by which the hose 41 as well is shuttled, flows into the molten slag 12. As already mentioned the hard material grains 31, if they are permeable to a magnetic field, are kept by the magnetic field induced by the electric current flowing through the electrode 13 and the molten slag 12, where the current path is continuously moving around, and by the force of the magnetic field are transported and distributed over the surface of the slag as far as to the rim of the funnel part 11 of the chill K. By the shape of the funnel part 11 in conjunction with the height h 1 of the molten slag 12 above the lower edge the distribution of the hard material grains 32, 33 and 34 in the molten slag 12, the molten metal S2 and the solidified material 14 across the cross section is defined. For example, when a larger funnel part volume is provided, the concentration of the hard material increases in the area near the surface.

During the current continuous process in different heights of the chill wall and underneath it and in the rim 1 different temperatures are measured, which signal the level of the slag surface and of the molten metal surface and to a certain extent the level of the solidification boundary. Therefore the temperature sensors TS1, TS2, TS3 are mounted in those positions, and they are connected to the control device ST, which controls depending on the named signals the following devices:

1. the slag dosing device Sd;
2. the height of the molten metal S3 by controlling the material currents **S23, 13*a*, 31** which are related to each other in given proportion depending on the receipt chosen;
3. the extraction speed of extraction device Z;
4. the current of the electrical generator G, which is connected with one connector to the chill K and with the other to the electrode 13.

The electrode 13 is either made from high melting material, e.g. tungsten, or it is water cooled from inside. It is connected to a shuttle or stirring device A/P, which moves it cyclic in a period of several seconds continuously over the middle area of surface of the molten slag 12, whereby the electrode is dipped to about $\frac{1}{4}$ or $\frac{1}{2}$ of the height of the molten slag into it.

In the case of the variation of the method whereby the electrode 13 consists of alloying material, there is the shuttle device which also involves a feeder driive, that is controlled in proportion to the alloying material needed corresponding to the current S23 of molten material.

For the feeding of the alloying material or in same circumstances also of the total melting material by way of the electrode such types of tubes, known as welding technology, or damping stripes filled with alloy materials may be used. The alloying materials are advantageously composed of two- or three-material alloys or crystals so that the melting point of such alloys are reduced considerably under the individual melting points and whereby the total composition gives the total final alloy material proportions. For example, ferro alloys are used like ferro silicon, ferro manganese, ferro chromium, ferro tungsten, or triple combinations are used like Fe'Cr'C; Fe'Si'Mn; Fe'W'C. The carrier material may be unalloyed iron or iron alloys containing chromium or nickel.

The electrical current of generator G or its related voltage is selected to such an intensity that the melting of the electrode 13 is reached in a depth of dipping of about $\frac{1}{3}$ of the height of the molten slag 12. Eventually it may be essential to use a combination of a melting electrode and an inest electrode in parallel if only a small amount of alloy material is needed and further heating current is necessary to reach the prescribed temperature of the molten slag.

The control device is a program controlled processor, the program of which works according to the method claimed. From the output circuitry of the control device ST control lines Sda, Vsa, Za, A/Pa, Ra are leading to the respective drives as are the slag dosing device Sd, the valve control Vs, the extracting device Z, the electrode feeding and shuttle device A/P, the hard material dosing device Ra, and control line Gs leads to the generator G, which may be a controllable transformer with or without a rectifier arrangement, or it may be a pulsed power control current generator as known from the welding technology. If voltage instead of current is controlled, a higher turbulence in the molten slag occurs because of the negative resistance characteristic of it, this normally is an advantage.

The operating conditions: extraction temperature, slag height, molten metal height, alloy material relation, shuttle displacement, slag temperature, etc. of the control procedures according to the method claimed are fed via input equipment E, e.g. a keyboard, into the control device ST. Working parameters and deviations from standard are fed via output equipment, e.g. a display device or a printer. The drives and the storage chests for molten metal S1, slag powder SP, hard material, grains and the electrode and cooling water reservoir are equipped with appropriate sensors, which monitor continuously the respective status on monitor lines RM to the control device ST. To handle the start up and end phases, the control device ST is connected to a clock CL, by means of the time signals of which the time constants of the molting device to reach the equilibrium state are derived, according to a special program. During the first operation of a chill type the control is directly performed by an operator, and the set of operating conditions is fed in and the actual signalized operating parameters are registered. During later operations the measured operating parameters are used as references for a feed back control, and the deviations of the actual measured signals to the registered are used for control of the respective control means as drives, valves etc. as listed before. The same takes place after stopping the process for a certain while e.g. for change of parts or replacement or refilling of materials.

It has been established that a temperature range between 1,700° C. and 2,000° C. for the molten slag is appropriate as far as tungsten carbid or hard metal scrap is used.

The slag powder SP can be made from mixtures, e.g.

45% silicon and titanium oxide, 10% calcium and magnesium oxide, 40% aluminium and manganese oxide, 5% calcium fluoride, or 35% silicon oxide, 20% magnesium oxide, 25% aluminium oxide, 10% calcium fluoride and others.

The extraction temperature of the material from the chill K should be at about 1,000° C., i.e. always under the melting point of the matrix material used. To achieve that the hard material grains 32 in the melting slag 12 melt or dissolve only on their surface, the slag height h and slag temperature are to be chosen in proper relation to the time they need for transition through it. The grain size and shape and their specific weight compared to that of the molten slag 12 in conjunction with the viscosity of it are the parameters to be encountered for that. A slag height of 4 cm is the average standard.

FIG. 6 is showing a cross section magnified by an electron microscope of a sample of material the matrix of which contains a high proportion of chromium and the hard material is tungsten carbide. The hard material H1 is tightly surrounded by a diffusion zone D1 being one micrometer or a few micrometers deep. The matrix material M1 is traversed in low concentration by dendrites D2 of hard material forming branches of a thickness of about one micrometer. The volume between the dendrites D2 is densely filled by matrix material.

FIG. 7 shows in lower magnification a cross section of a material with a matrix of unalloyed steel type ST 37-2 containing about 0.18% carbon, and with built-in sintered hard metal grains from WC+TaC+TiC, which have the reference number H2 in the picture. The inner diffusion zone is not visible, because of less magnification compared to FIG. 6.

The dendrite zone D20 extends from the grain H3 for about 100 micrometers into the matrix material. Another 30 micrometers deep a diffusion zone D30 of hard material in low concentration extends beyond the dendrites, and beyond this zone pure matrix material M2 is to be seen.

It is under the scope of the invention to produce according to the method claimed castings in a two part chill with closed bottom, in which at the beginning of the process molten hot slag is filled, whereafter continuously the molten metal and the hard material grains are filled respectively scattered into it while the slag is heated by electrical current via the electrode. Thus, without further machining chisels, drillings, drilling crowns, scraper teeth, plough cutting knives etc. can be produced whereas the doping can be one locally according to the application needs especially at the outer surfaces, the cutting edge etc. The control device ST is according to its program prepared to control such individual molting processes as appropriate and starts and stops and controls the drives and valves for the respective times and amounts.

A simplification of the control device and the process device is given if the hard material grains 31 are already in the wanted proportion contained in the electrode material together with the alloy components. A separate hard material dosing device R and chest 40 can be missing.

In so far as different alloys and dopings shall be produced with the same process device there will be the necessity to keep several types of electrodes in stock. Using a combination of a number of different electrodes in parallel gives the possibility to cover a wide range of different materials by a limited number types of electrodes.

It is also possible to feed the stripes containing the alloy materials into the molten slag without connecting them to the electrical generator. Then the melting energy is extracted locally from the slag giving a local temperature decrease which under certain circumstances may advantageously be used, because the temperature distribution has an effect on the crystallisation process. Cross sections of the material produced, can be analysed on this effect by an expert.

TABLE 1

| | | | MARTENSITIC | | | | |
|---|---|---|---|---|---|---|---|
| | Rc | C | Mn | Si | Cr | Mo | OTHERS |
| 1 | 30–35 | 0,14 | 2,00 | 0,5 | 1,6 | 0,36 | — |
| 2 | 42–44 | 0,20 | 2,40 | 0,80 | 3,10 | 0,50 | — |
| 3 | 44–48 | 0,25 | 2,50 | 0,80 | 5,60 | 0,60 | V = 0,3o |
| 4 | 44–48 | 0,25 | 2,10 | 0,60 | 13,00 | — | — |
| 5 | 40–45 | 1,8 | 2,50 | 1,80 | 35,0 | — | Cu = 3,0<br>V = 1,0 |
| 6 | 54–58 | 0,50 | 2,50 | 0,80 | 6,50 | 1,2 | V = 0,3 |
| 7 | 56–60 | 0,50 | 2,50 | 0,60 | 6,00 | 1,60 | W = 1,30 |
| 8 | 55–60 | 0,60 | 1,50 | 0,50 | 4,50 | 3,50 | W = 4,0 |
| 9 | 58–61 | 1,80 | 2,40 | 0,90 | 6,00 | 0,60 | Ti = 5,50 |
| 10 | 62–64 | 5,0 | 2,70 | 0,70 | 34,0 | — | — |

TABLE 1-continued

| | | | MARTENSITIC | | | | |
|---|---|---|---|---|---|---|---|
| | Rc | C | Mn | Si | Cr | Mo | OTHERS |
| 11 | 64–66 | 4,0–5,0 | 2,50 | 0,80 | 25,0 | — | Nb = 7,0 |

I claim:

1. In a process for the manufacture of metal blocks, castings, or profile material from molten metal which is transferred in a chill from an upper heating zone into a lower cooling zone, cooled by water with such a speed theat the solidification of the molten metal proceeds, the process including continuously feeding a grain material from the upper heating zone onto the surface of the molten metal, the improvement which comprises selecting a hard material having a higher density than the molten metal, maintaining a temperature below that of the melting temperature of the hard material, maintaining the heating zone at a temperature which is higher than the melting point of the hard material grains, passing the hard material grains with a speed through the heating zone such that the grains melt on their surface to a depth of just about a micrometer before entering the molten metal, and feeding the grains in a given distribution pattern onto the surface of the molten metal.

2. A process according to claim 1, wherein the improvement further comprises the heating zone containing a plasma furnace in a protective gas atmosphere.

3. A process according to claim 1, wherein the improvement further comprises the heating zone including molten slag and the heating conducted by electrically resistively heating the molten slag beyond the melting point of the hard material grains, and the molten slag being of such a height that the hard material grains melt to a depth of about one micrometer while passing through the molten slag.

4. A process according to claim 3, wherein the height of the molten slag is between 1 and 5 cm and the composition of the slag is 45% silicon oxide and titanium oxide, 10% calcium oxide and magnesium oxide, 40% aluminum oxide and manganese oxide, and 5% calcium fluoride, or 35% silicon oxide, 20% magnesium oxide, 25% aluminum oxide, and 10% calcium flouride and other compounds.

5. A process according to claim 4, wherein the slag temperature ranges from 2000° C. for 1 cm and 1700° C. for 5 cm.

6. A process according to claim 1, wherein the improvement further comprises an electric power supply being connected with one polarity to the chill and with the other polarity to an electrode which is made from an inert material and moves across or circulates in the middle area of the slag surface and is dipped into the slag for about ¼ to ½ of the height and wherein the hard material grains are fed near to the electrode as it moves, thereby defining the distribution pattern of the hard material grains.

7. A process according to claim 1, wherein the improvement further comprises connecting one terminal of an electric supply to the chill, connecting the other terminal of the electric supply to an electrode, said electrode comprises a metal, continuously melting the electrode in the molten slag, feeding the electrode into the slag along the middle area of the slag surface together with a further feed in a current of molten metal to obtain a desired composition of the molten metal in the chill, wherein the slag temperature is so high that the electrode melts in a depth of ¼ to ½ of the height of the slag.

8. A process according to claim 7, further comprising fixing hard metal grains and alloy components for the molten metal on the electrode, the electrode being made from a tube or strip, the melting point of the tube or strip being lower than the temperature of the molten slag and higher than the temperature of the molten metal.

9. A process according to claim 1, further comprising extracting from the molten metal solidified material from the cooling zone with such a speed that the solidification of the molten metal continues, and wherein the molten metal current is controlled such that the height of the molten metal is about 2 to 10 cm.

10. A process according to claim 9, further comprising directing molten metal from a melting device into a slag catching chest, feeding the molten slag from the chest through a controllable bottom valve via a funnel to the molten metal in the chill, controlling the valve in a feed back mode depending on the height or the weight of the molten metal in the funnel in comparison to a given value, thereby providing a constant material current, and extracting solidified material from the bottom of the chill with such an extraction speed that the extraction temperature is about 1,000° C., and whereby in proportion to the extraction speed, the given values, the dosing of the hard material grains and the feeding speed of the electrode are derived.

11. A process according to claim 1, wherein the distribution of the hard material into molten metal is done in a vacuum.

12. In an apparatus for the manufacture of metal blocks, castings, or profile substances solidified from molten metal including a widening chill of a first material, being cooled by flowing water, and extending on top of the molten metal surrounding a space for keeping a molten slag which has at least a given height, and a grain material dosing device for feeding a grain material to the slag, the improvement comprising the chill surrounding the molten slag and widening in the shape of a funnel ending in a rim composed of a second material, said second material being a less heat conducting material than the first material of the chill, the grain material dosing device having an outlet connected to a shuttle or a circulating device for performing a movement of an amplitude reaching near to the rim, the apparatus further comprising (a) a molten metal dosing device, (b) a slag powder dosing device, (c) a holder mounted on a feeding and shuttle device for an electrode and the grain material dosing device, and (d) an extracting device disposed underneath of the chill.

13. An apparatus according to claim 12, wherein the molten metal dosing device comprises a slag catching chest with a controllable bottom valve, a funnel with an outlet, a weight sensor mounted to the funnel, a means for transmitting a signal from the weight sensor to a regulating device, the regulating device being part of a control device, a means for providing a constant molten material incoming current, said means for providing a constant molten material incoming current disposed at the end of the outlet, a means for comparing a signal from the regulation device with a value being in proportion to the solidification speed and the extraction speed of the solidified material, and a means for transmitting an output signal to a bottom valve control.

14. An apparatus according to claim 13, which further comprises (a) a means for transmitting a signal from the control device at its inputs to a weight sensor, to temperature sensors in the rim of the chill, to the inner chill wall, to the material outlet from the chill, to monitor contacts or sensors of the bottom valve control, to the feeding and shuttle device, to the slag dosing device, to the grain material dosing device, to a generator, and to an extracting device, and at its outputs to control signal lines for the control of the respective drives, or the current or voltage of the generator (b) a clock acting on the control devices in conjunction with a program contained in the control device and via input equipment containing given process parameters, (c) an output device for receiving deviations of prescribed process parameters, (d) a means for transmitting a signal from a temperature sensor in the rim of the chill for controlling the height of the molten slag by acting on the slag dosing device and for controlling the electric current or voltage of the generator, and (e) a means for transmitting a signal from a temperature sensor in the wall of the chill for controlling the dosing of the grain material.

* * * * *